US008503893B2

(12) United States Patent
Yoshida et al.

(10) Patent No.: US 8,503,893 B2
(45) Date of Patent: Aug. 6, 2013

(54) IMAGE FORMING APPARATUS AND METHOD FOR CONTROLLING IMAGE DENSITY

(75) Inventors: Akira Yoshida, Sagamihara (JP); Nobutaka Takeuchi, Yokohama (JP); Shin Hasegawa, Zama (JP); Yoshiaki Miyashita, Komae (JP); Kohta Fujimori, Yokohama (JP); Kayoko Tanaka, Machida (JP)

(73) Assignee: Ricoh Company, Ltd., Tokyo (JP)

( * ) Notice: Subject to any disclaimer, the term of this patent is extended or adjusted under 35 U.S.C. 154(b) by 533 days.

(21) Appl. No.: 12/714,790

(22) Filed: Mar. 1, 2010

(65) Prior Publication Data

US 2010/0226664 A1 Sep. 9, 2010

(30) Foreign Application Priority Data

Mar. 5, 2009 (JP) ..... 2009-051669

(51) Int. Cl.
*G03G 15/08* (2006.01)

(52) U.S. Cl.
USPC ..... 399/30; 399/258

(58) Field of Classification Search
USPC ..... 399/30
See application file for complete search history.

(56) References Cited

U.S. PATENT DOCUMENTS

| | | | |
|---|---|---|---|
| 5,182,600 | A | 1/1993 | Hasegawa et al. |
| 5,198,861 | A | 3/1993 | Hasegawa et al. |
| 5,327,196 | A | 7/1994 | Kato et al. |
| 5,387,965 | A | 2/1995 | Hasegawa et al. |
| 5,630,195 | A | 5/1997 | Sawayama et al. |
| 5,761,570 | A | 6/1998 | Sawayama et al. |
| 5,857,131 | A | 1/1999 | Hasegawa |
| 5,860,038 | A | 1/1999 | Kato et al. |
| 6,055,386 | A | 4/2000 | Kato et al. |
| 6,160,569 | A | 12/2000 | Fujimori et al. |
| 6,496,677 | B2 | 12/2002 | Fujimori |
| 7,228,081 | B2 | 6/2007 | Hasegawa et al. |

(Continued)

FOREIGN PATENT DOCUMENTS

| | | |
|---|---|---|
| JP | 2002-207357 | 7/2002 |
| JP | 2006-259334 | 9/2006 |
| JP | 2007-71985 | 3/2007 |
| JP | 2007-199145 | 8/2007 |

OTHER PUBLICATIONS

Office Action issued Mar. 5, 2013, in Japanese Patent Application No. 2009-051669, filed Mar. 5, 2009, 3 pages.

*Primary Examiner* — Walter L Lindsay, Jr.
*Assistant Examiner* — David Bolduc
(74) *Attorney, Agent, or Firm* — Oblon, Spivak, McClelland, Maier & Neustadt, L.L.P.

(57) ABSTRACT

An image forming apparatus includes a developer unit to store two-component developer which includes toner and carrier and develop an electrostatic latent image formed on the image carrier, a toner concentration detector to detect toner concentration in the developer unit, a toner supply unit to supply toner to the developer unit, and a controller to control toner supply amount by controlling the toner supply unit by comparing an output value of the toner concentration detector with a reference value stored in a memory and correcting difference between output values of the toner concentration detector at two or more process linear velocities in accordance with the toner concentration in the developer unit. A compensation amount for correcting difference between output values of the toner concentration detector that differ depending on the process linear velocity is adjustable in accordance with the toner concentration in the development unit.

13 Claims, 6 Drawing Sheets

U.S. PATENT DOCUMENTS

| | | | | |
|---|---|---|---|---|
| 7,251,420 | B2 | 7/2007 | Fujimori | |
| 7,655,936 | B2 | 2/2010 | Sawayama et al. | |
| 2004/0251435 | A1 | 12/2004 | Sawayama et al. | |
| 2007/0036566 | A1 * | 2/2007 | Takeuchi et al. | 399/27 |
| 2007/0053703 | A1 * | 3/2007 | Hirayama | 399/27 |
| 2008/0205923 | A1 | 8/2008 | Takeuchi et al. | |
| 2009/0110413 | A1 | 4/2009 | Takeuchi et al. | |
| 2009/0202263 | A1 | 8/2009 | Yoshida et al. | |
| 2009/0324267 | A1 | 12/2009 | Yoshida et al. | |
| 2010/0086320 | A1 | 4/2010 | Koizumi et al. | |
| 2010/0086322 | A1 | 4/2010 | Koizumi et al. | |

* cited by examiner

IMAGE FORMING APPARATUS AND METHOD FOR CONTROLLING IMAGE DENSITY

This patent specification is based on Japanese Patent Application No. 2009-51669, filed on Mar. 5, 2009 in the Japan Patent Office, which is incorporated by reference herein in its entirety.

BACKGROUND OF THE INVENTION

1. Field of the Invention

The present invention relates to an image forming apparatus and a method for controlling image density in the image forming apparatus, and more particularly to an image forming apparatus and a method for controlling image density in the image forming apparatus.

2. Discussion of the Background

Background image forming apparatuses, such as printers, facsimiles, copiers, and multifunction apparatuses which print, fax, copy, and so on, generally use an electrophotographic process for image formation. Such image forming apparatuses need to print high-quality pictures and operate reliably. More specifically, such image forming apparatuses need to maintain good image quality unaffected by environmental changes and provide consistently high-quality images.

To satisfying such requirements, a two-component developer development method has become widely known in recent years because it is easy to apply to color image formation.

In the two-component developer development method, two-component developer (hereinafter simply "developer") that includes both non-magnetic toner and magnetic carrier is used. The two-component developer is held on a developer carrier (hereinafter "sleeve"). A magnetic brush is formed by magnetic poles provided inside the sleeve. A development bias is applied at a position where the development sleeve faces a latent image carrier (hereinafter "photoreceptor") to develop an electrostatic latent image on the photoreceptor into a visible toner image. Rotation of the development sleeve brings the two-component developer to a development zone, where a large amount of magnetic carrier covered with toner in the developer rolls up along magnetic field lines to form the magnetic brush.

Unlike a single-component developer development method, with the two-component developer development method it is extremely important to control weight ratio (toner concentration) between toner and carrier precisely to improve stable operation. For example, when the toner concentration is too high, the image may appear grainy, with decreased detail resolution. When the toner concentration is too low, density in filled-in areas is decreased, and a carrier adhesion problem may occur. To control image density appropriately, it is necessary to control toner concentration in the developer by controlling the amounts in which the toner is supplied, so that the toner concentration is kept within a predetermined range.

Toner concentration control can be performed using a toner concentration detector (permeability sensor). By comparing an output value Vt of the toner concentration detector (permeability sensor) with a toner concentration control reference value Vtref, a proper toner supply amount is then determined based on the comparison result. A permeability sensor is generally used to detect the toner concentration, in which current toner concentration is detected based on a change in permeability of the developer due to change in toner concentration, obtained by comparing detected permeability with a reference value of the toner concentration.

Alternatively, an optical sensor may also be used for detecting the toner concentration. In a method using the optical sensor, a reference pattern is formed on an image carrier or an intermediate transfer belt. The optical sensor detects reflected light from the reference pattern to obtain any difference between an image portion and a non-image portion of the reference pattern. The toner concentration is obtained based on the detected difference.

The reference pattern is typically formed in an interval between successive printing processes, to successively provide the toner concentration control reference value Vtref. However, there is strong demand to reduce consumption of the toner used to form the reference pattern between sheets of recording media. Accordingly, this method has not been employed in most apparatuses recently. Further, when the reference pattern is formed on the intermediate transfer belt, it is necessary to employ a cleaning device on a secondary transfer roller. Accordingly, it may be preferable to avoid use of this method in which the reference pattern is formed between successive sheets of paper or the like from the point of view of mechanical cost reduction. Therefore, it is all the more important to control the toner concentration using a single permeability sensor during successive printing operations and imaging mode change (change in linear process velocity).

In the permeability detection method, the permeability of magnetic carrier is detected to get the permeability of the developer. Accordingly, if a bulk density of the developer is changed, the permeability of the developer is also changed, resulting in a change in the detection output value. More specifically, even if the ratio of toner to carrier remains constant, the permeability of the developer is changed because the carrier amount per unit volume in developer is changed when the bulk density of the developer is changed. As a result, the output value of the toner concentration sensor may be changed.

For example, in an image forming system which has image output modes covering a plurality of different linear velocities, a rotation speed of an agitation screw provided in the development unit varies in the image output mode. More specifically, even if the toner concentration remains the same, the output value of the toner concentration sensor is varied by the bulk density, charging amount and flowability of the developer due to a change of the agitation speed when the process linear velocity is changed. Hereinafter, a difference of the output value Vt of the toner concentration sensor corresponding to a difference of process linear velocity is expressed as a linear velocity shift.

When the output value of the toner concentration sensor is changed even with the same toner concentration at the change of the process linear velocity, it is not possible to control the toner concentration of the development unit to keep a predetermined toner concentration. Therefore, the linear velocity shift at the change of the linear velocity is obtained preliminarily from experimental data to use as the toner supply amount.

JP-2002-207357-A describes an image forming apparatus that includes a permeability sensor that detects the toner concentration of the developer in the development unit. The detected value is compared to a threshold value, and based on the comparison result, the toner concentration of the developer in the development unit is controlled. Further, the threshold value for the detected value of the toner concentration is changed in accordance with the change of the linear velocity in the image forming apparatus.

JP-2007-71985-A describes an image forming apparatus which performs an adjustment mode to detect the linear velocity shift. When certain predetermined conditions are satisfied, the image forming apparatus performs the adjustment mode so that the linear velocity shift is renewed.

However, in both prior arts disclosed in JP-2002-207357 and JP-2007-71985, compensation amount of the linear velocity shift is constant when the toner concentration is changed. In other words, it is possible to correct the output value of the sensor for a certain condition of the toner concentration. However, in a development unit in which the toner concentration is changed due to a change of the linear velocity shift, some errors may be observed in the compensation amount.

SUMMARY OF THE INVENTION

This patent specification describes a novel image forming apparatus which includes a developer unit, a toner concentration detector, a toner supply unit, and a controller. The developer unit is configured to store two-component developer that includes toner and carrier and develop an electrostatic latent image formed on an image carrier. The toner concentration detector is configured to detect toner concentration in a developer unit. The toner supply unit is configured to supply toner to the developer unit. The controller is configured to control toner supply amount. The controller functions as a toner supply controller having a memory and to control the toner supply unit by comparing an output value of the toner concentration detector with a reference value stored in the memory and as a compensation unit to correct a difference between output values of the toner concentration detector at two or more process linear velocities including a standard linear velocity. A compensation amount for correcting the difference between output values of the toner concentration detector that differ depending on the process linear velocity is adjustable in accordance with the toner concentration in the development unit. The compensation amount for correcting difference between output values of the toner concentration detector may be determined in accordance with the output value of the toner concentration sensor at the standard linear velocity stored just before the process linear velocity is changed.

The compensation amount may be set to a value larger than a reference value when the output value of the toner concentration detector is at or below a predetermined value, and the compensation amount may be set to a smaller value than the reference value when the output value of the toner concentration is higher than the predetermined value.

The compensation unit may further correct a difference between output values of the toner concentration detector at two or more process linear velocities including a standard linear velocity and a low linear velocity in accordance with the toner concentration in the developer unit. A compensation amount for correcting the difference between output values of the toner concentration detector may be determined using a relational equation between the output values of the toner concentration detector for each of the standard linear velocity and the low linear velocity and the toner concentration.

The image forming apparatus may have a calculation mode to derive the relational equation.

The compensation amount for correcting the difference between output values of the toner concentration detector may be determined just after the process linear velocity is changed from the standard linear velocity to the low linear velocity.

The calculation mode to derive the relational equation may be entered at detection of installation of a new development unit.

The image forming apparatus may enter the calculation mode when the difference between the output values of the toner concentration detector obtained before and after the linear velocity is changed from low to standard exceeds a predetermined value.

This patent specification further describes a novel method for controlling an image density used in the above-described image forming apparatus. The method for controlling an image density includes the steps of storing two-component developer which includes toner and carrier, detecting toner concentration in a developer unit of the image forming apparatus with a toner concentration detector, correcting a difference between output values of the toner concentration detector at two or more process linear velocities of the image forming apparatus including a standard linear velocity and a low linear velocity, determining the toner supply amount by comparing the output value of the toner concentration detector with a reference value stored in a memory of the image forming apparatus, and toner to the developer unit with a toner supply unit of the image forming apparatus. A compensation amount for correcting the difference between output values of the toner concentration detector that differ depending on the process linear velocity of the image forming apparatus is adjustable in accordance with the toner concentration in the development unit.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
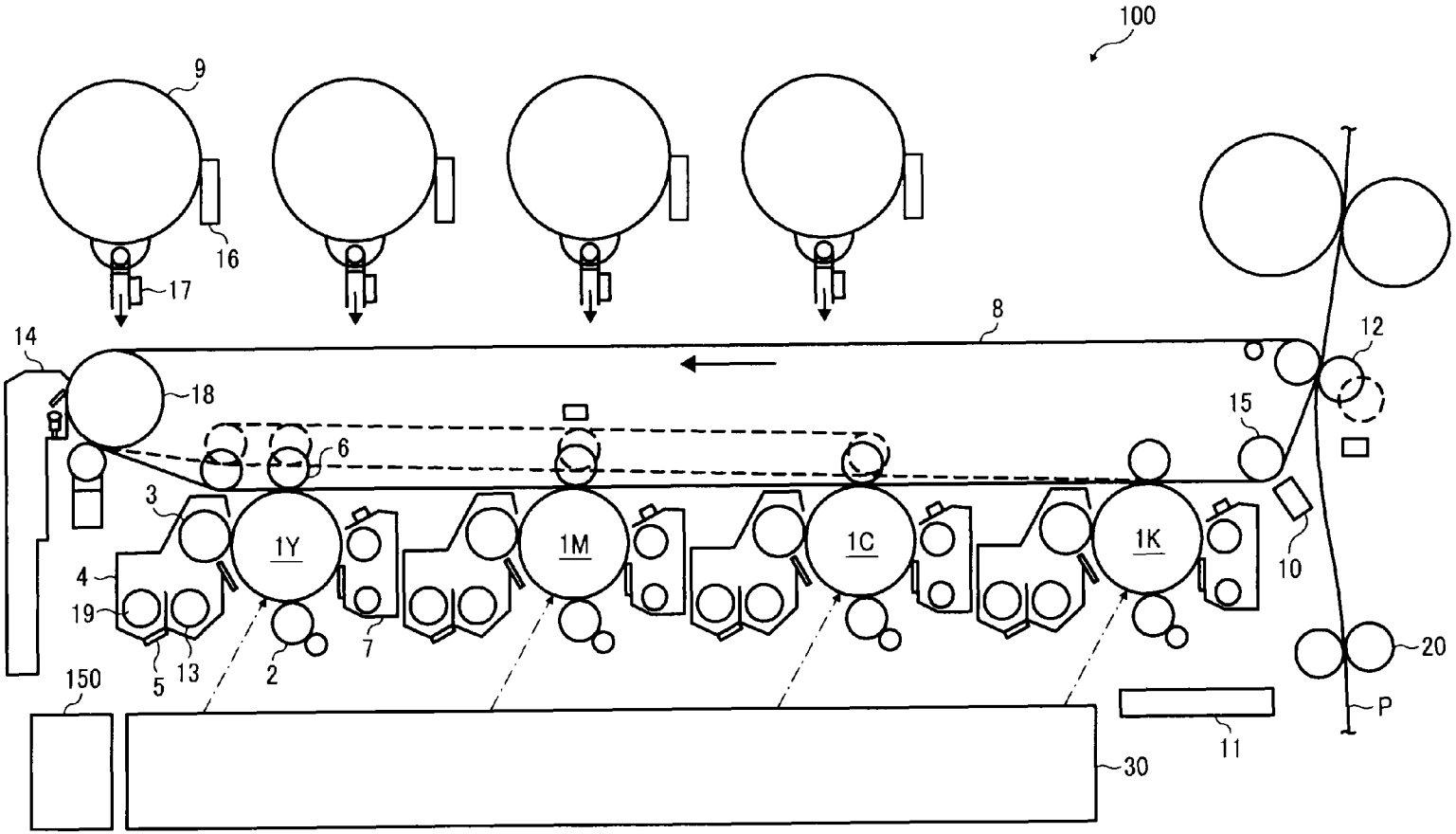
FIG. 1 is a schematic of an example image forming apparatus according to an embodiment of the present invention.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Referring now to the drawings, wherein like reference numerals designate identical or corresponding parts throughout the several views, particularly to FIG. 1, an image forming apparatus 100 according to an embodiment of the present invention is described.

FIG. 1 is a cross-sectional view of an example of an image forming apparatus 100 according to an exemplary embodiment of the present invention. In FIG. 1, a color copier is shown as an example of the image forming apparatus 100.

As illustrated in FIG. 1, the image forming apparatus 100 includes four photoreceptors having a drum shape (hereinafter, expressed as photosensitive drum) 1Y, 1M, 1C and 1K, in the center of a main body 1, wherein Y, M, C, and K represent the colors yellow, magenta, cyan, and black, respectively. All four photoreceptors function essentially identically.

The photosensitive drum 1Y for yellow color image will be now described.

The photosensitive drum 1Y is driven to rotate in a counterclockwise direction by a drive motor, not shown, in FIG. 1. Underneath the photosensitive drum 1Y, an imaging unit is provided. In the imaging unit, a development device which includes a charging device 2 (a charging roller in FIG. 1) and a cleaning device 7 are arranged in a predetermined order. The imaging units for other color, i.e., magenta, cyan and black, have a similar configuration.

A surface of the photosensitive drum 1 (1Y, 1M, 1C, and 1K) is charged uniformly by the charging roller 2. Then, the photosensitive drum 1 is exposed by an optical system 30, details of which are not shown, to form an electrostatic latent image in accordance with image information. The developer in the development unit 4 is conveyed to a development nip region where the photosensitive drum faces to render visible the electrostatic latent image by adhering toner onto the electrostatic latent image formed on the photosensitive drum 1.

A toner image formed on the photosensitive drum 1 is transferred onto an intermediate transfer belt 8 by a primary transfer unit 6 (a primary transfer roller in FIG. 1). The intermediate transfer belt 8 is extended among a drive roller 18 and a plurality of driven rollers 15. During a movement of the intermediate transfer belt 8, each color toner is transferred on the intermediate transfer belt 8 in sequential order of Y, M, C, and K. As a result, color images are superimposed. The color image formed by being superimposed is conveyed to a secondary transfer region that faces a secondary transfer device 12 (a secondary transfer roller in FIG. 1). Meanwhile, a recording medium (for example, paper) stored in a storage unit (a paper cassette or paper tray) is conveyed to the secondary transfer region by a paper feed unit (a paper feed roller, a separation roller and a conveyance roller). The image on the intermediate transfer belt 8 is transferred onto the recording medium P by the secondary transfer device 12 to form the image on the recording medium P.

Further, a cleaning device 7 is provided to wipe off unnecessary toner that remains on the photosensitive drum 1 after a transfer process, and collects the unnecessary toner in a waste toner bottle, not shown. Similarly, an intermediate transfer belt cleaning device 14 is provided to wipe off unnecessary toner that remains on the intermediate transfer belt 8 after a transfer process, and collects the unnecessary toner in a waste toner bottle, not shown. After the cleaning process for the photosensitive drum 1 and the intermediate transfer belt 8 is completed, the processes described above are performed repeatedly to perform image formation.

The development unit 4 includes a development roller 3 that is a developer carrier. The development roller 3 is provided to face the photosensitive drum 1, and includes a development sleeve and a plurality of magnetic poles. The development sleeve holds and conveys the two-component developer which includes magnetic carrier and non-magnetic toner. The magnetic poles are fixedly arranged inside the development sleeve, and are formed by a plurality of magnets or by a magnetic roller which includes a plurality of magnetic poles.

Further, the development unit 4 includes a bi-axial conveyance screw which includes first convey screw 13 and a second convey screw 19. A toner concentration sensor 5 that detects toner concentration is provided underneath a development room of the second convey screw 19. As for the toner concentration sensor 5, a sensor that detects the permeability of the toner in the development unit 4 may be used.

Figure 2:
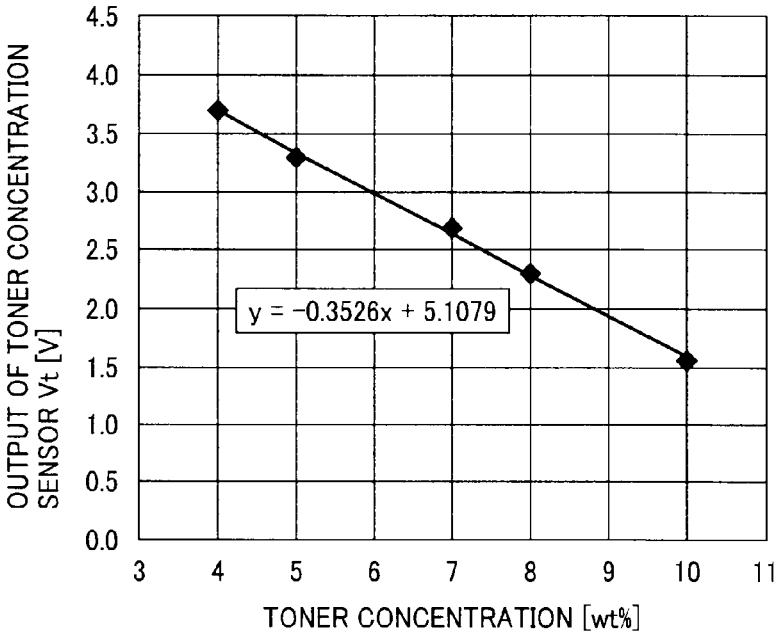
FIG. 2 is a graph representing an example characteristic of a toner concentration sensor.

FIG. 2 is a graph representing an example characteristic of the toner concentration sensor 5, where the vertical axis represents the output value of the toner concentration sensor 5 and the horizontal axis represents the toner concentration. Referring to FIG. 2, it is found that the output value is small in a region where the toner concentration is large. As shown in FIG. 2, it is possible to provide a straight-line approximation for a relation between the output value of the toner concentration sensor and the toner concentration.

In this example embodiment, the image forming apparatus 100 includes a control unit 150. The control unit 150 serves as a controller that controls the toner concentration so as to control image density. In this toner concentration control, the output value Vt of the toner concentration sensor 5 is compared with a toner concentration reference value Vtref. A toner supply amount is determined by a calculation based on a formula in accordance with a difference between the output value Vt and the reference value Vtref. A toner supply unit 17 supplies toner from a toner bottle 9 to the development unit 4. In the toner bottle 9, a toner sensor 16 is provided to detect the toner amount in the toner bottle 9.

As described above, the image forming apparatus 100 according to the example embodiment of the present invention includes the control unit 150 serving as a controller. The control unit 150 may be a computer that includes a central processing unit (CPU), a variety of memories such as a read only memory (ROM), a random access memory (RAM), and a nonvolatile RAM, a clock generator, input and output devices (I/O, I/F), and a variety of control circuits. The control unit 150 calculates the correct toner supply amount based on the output value of the toner concentration sensor 5. More specifically, the control unit 150 serves and functions as a toner supply electric controller to drive the toner supply unit 17 to supply toner for a certain time determined by comparing the output value of the toner concentration sensor 5 with a toner concentration reference value Vtref stored in a storage device (memory). Further, the control unit 150 serves and functions as a compensation unit that can compensate for a toner concentration difference in output values of the toner concentration sensor 5 among two or more different process linear velocities. According to a control operation using a compensation method that is described later, an appropriate toner supply amount is calculated to perform toner supply amount control.

Output signals are input to the control unit 150 from a variety of sensors such as an optical sensor 10 and a humidity and temperature sensor that detects humidity and temperature in the image forming apparatus 100. The optical sensor 10 detects deviations such as positional misalignment or color shift of the image transferred on the intermediate transfer belt 8. The control unit 150 controls operations and conditions at each unit.

A measurement procedure for measuring a characteristic of the developer and a compensation control operation performed in the example embodiment of the image forming apparatus 100 will be now described.

Figure 3:
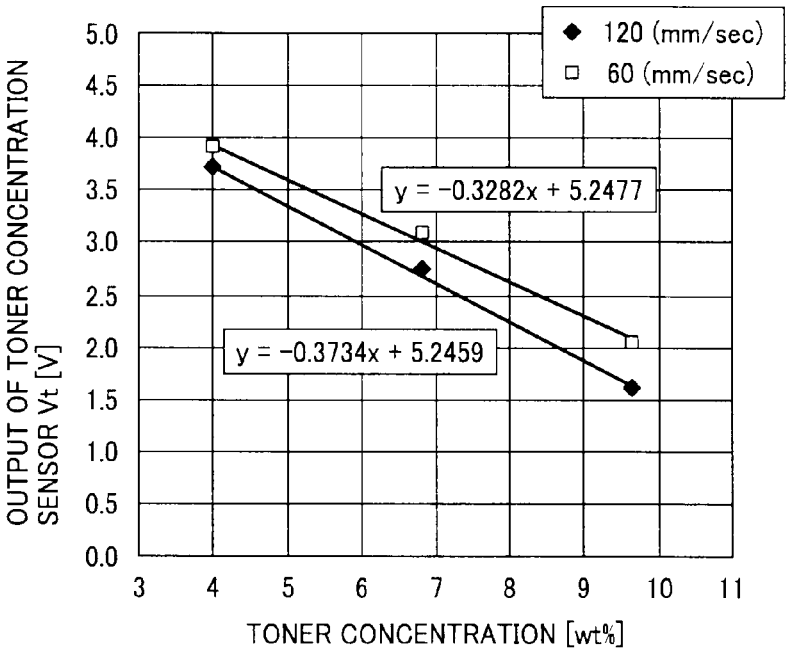
FIG. 3 is a graph representing a relation between output value of the toner concentration sensor of FIG. 2 at each of several different process linear velocities and toner concentration.

FIG. 3 is a graph representing a relation between the output value Vt of the toner concentration sensor 5 at each of several different process linear velocities and the toner concentration Tc. As shown in FIG. 3, comparing the process linear velocities, i.e., a process linear velocity in standard mode (for example, standard linear velocity: 120 mm/sec), and a process linear velocity at a low linear velocity mode (for example, low linear velocity: 60 mm/sec), it is found that the output value Vt at a slower process linear velocity tends to be higher than the output value Vt at a faster process linear velocity (linear velocity shift). Accordingly, when the output value Vt from the toner concentration sensor 5 that is measured for the toner concentration in the development device 4 at lower process linear velocity is used to calculate a toner supply amount, the toner supply amount may be mismatched. Consequently, toner may not be supplied properly.

For this reason, when image forming operation is performed at a low process linear velocity, a converted output value Vt is used to control the toner supply amount. More specifically, the output value Vt1 from the toner concentration sensor 5 at the lower process linear velocity is converted to the corresponding output value Vt for the standard linear velocity using the following formula:

$$Vt=Vt1-\Delta Vt,$$

where "Vt" is the corresponding output value of the toner concentration sensor 5 for the standard linear velocity and "Vt1" is the output value from the toner concentration sensor 5 at the low linear velocity. As for "ΔVt", a fixed value obtained from experiments performed in advance is used as the value of ΔVt.

However, as shown in FIG. 3, linear velocity shift amount may be changed in accordance with the toner concentration in another development device 4. Accordingly, if the linear velocity shift amount is corrected with the fixed value, the compensation amount may be excessive or insufficient depending on the toner concentration. As a result, the toner concentration may not be controlled stably because the toner supply amount deviates from a desired toner supply amount. Therefore, it is necessary to change the linear velocity shift amount in accordance with the toner concentration.

Figure 4:
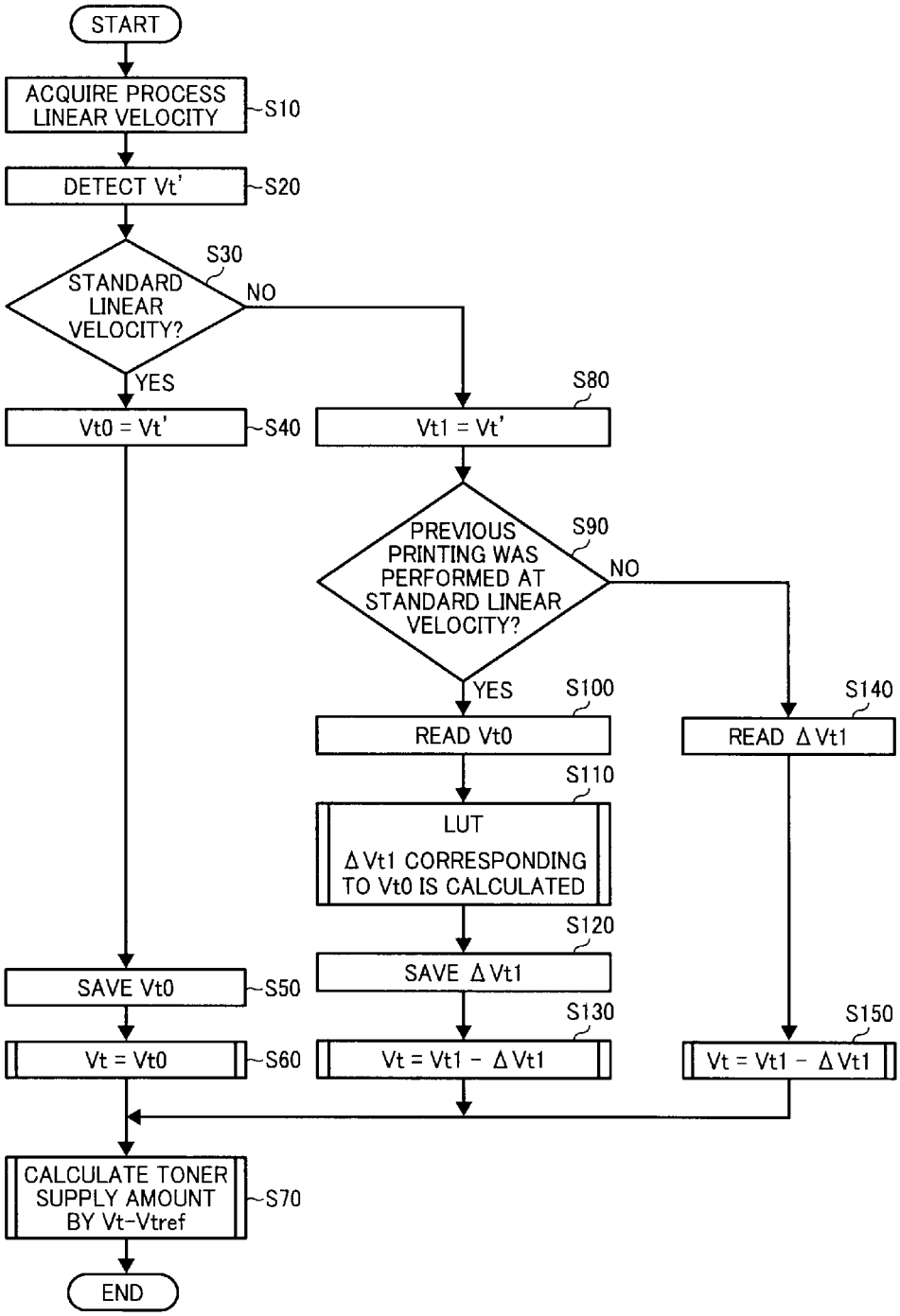
FIG. 4 is a flowchart of steps in a compensation method to correct the output value of the toner concentration sensor.

A Vt compensation method to correct the output value Vt of the toner concentration sensor 5 will be now described using a flowchart shown in FIG. 4.

In this example embodiment, the toner control method will be described for a case in which two types of linear velocity modes, a standard linear velocity (for example, 120 mm/sec) and a low linear velocity mode (for example, 60 mm/sec), are employed.

In FIG. 4, a current process linear velocity is acquired in step S10. The output value Vt' from the toner concentration sensor 5 is detected in step S20 where "Vt'" is a detected value and a value before compensation.

Next, the process linear velocity is identified in step S30. If the process linear velocity is a standard linear velocity, the process proceeds to step S40. In step S40, the output value Vt' detected in step S20 is input to the formula:

$$Vt0=Vt',$$

after which the process proceeds to step S50 and the output value Vt0 is saved. The saving process in step S50 may be performed at each printing process or only once at the end of the job. In this example embodiment, the job ends when the process linear velocity is changed. In a system in which the linear velocity can be changed during the job, the output value Vt0 is saved just before the linear velocity is changed. This output value Vt0 will be used in a control flow at the low process linear velocity, described later.

Then, in step S60, Vt=Vt0.

In step S70, the toner supply amount is calculated using the output value Vt and the toner concentration control reference value Vtref. More specifically, when the process linear velocity is the standard linear velocity, the original output value from the toner concentration sensor 5 is used without correction to calculate the toner supply amount.

When the process linear velocity acquired in step S10 is the low linear velocity (60 mm/sec), the process proceeds to step S80 by a determination made in step S30. At step S80, Vt1=Vt'.

In step S90, it is judged whether the previous linear velocity was the standard linear velocity. If the previous linear velocity was the standard linear velocity, the process proceeds to step S100.

In step S100, the output value Vt0 from the toner concentration sensor at the standard linear velocity stored in the memory is read.

The output value Vt0 of the toner concentration sensor at the standard linear velocity read from the memory is a value at the standard linear velocity stored just before the linear velocity is switched. Using the value at the standard linear velocity stored just before the linear velocity is switched, a linear velocity shift compensation amount ΔVt1 for compensation is determined based on a look up table (LUT) in step S110. The output value Vt0 at the standard linear velocity stored just before the linear velocity is switched is used because the toner concentration is constant around the time when the linear velocity is switched. In step S120, the linear velocity shift compensation amount ΔVt1 is saved.

Table 1 is an example of a look up table (linear velocity shift compensation table) used in this example embodiment.

TABLE 1

| Linear Velocity Shift Compensation | |
|---|---|
| Vt0 [V] | ΔVt1 [V] |
| 3.60 ≦ Vt0 | 0.18 |
| 3.30 ≦ Vt0 < 3.60 | 0.23 |
| 3.00 ≦ Vt0 < 3.30 | 0.27 |
| 2.40 ≦ Vt0 < 3.00 | 0.32 |
| 2.10 ≦ Vt0 < 2.40 | 0.36 |
| 1.80 ≦ Vt0 < 2.10 | 0.41 |
| 1.50 ≦ Vt0 < 1.80 | 0.45 |
| Vt0 < 1.50 | 0.50 |

It is found in FIG. 3 that the linear velocity shift amount is large when the toner concentration is high, and the linear velocity shift amount is small when the toner concentration is low. Accordingly, in the look up table shown in Table 1, when the toner concentration is larger than a predetermined value, (when the output value of the toner concentration sensor is below a predetermined value) the linear velocity shift amount is set to a larger value than the reference value. Further, when the toner concentration is below a predetermined value (when the output value of the toner concentration sensor is greater than a predetermined value), the linear velocity shift amount is set to a smaller value than the reference value.

The other linear velocity shift compensation tables, for example, Tables 2 and 3, may be prepared to fit the characteristic of the development devices 4. Further, the look-up-table may be arranged to have more precise steps to fit the characteristic of the development device 4.

TABLE 2

| Linear Velocity Shift Compensation | |
|---|---|
| Vt0 [V] | ΔVt1 [V] |
| 3.60 ≦ Vt0 | 0.18 |
| 3.30 ≦ Vt0 < 3.60 | 0.23 |
| 3.00 ≦ Vt0 < 3.30 | 0.27 |
| 2.40 ≦ Vt0 < 3.00 | 0.32 |
| 2.10 ≦ Vt0 < 2.40 | 0.32 |
| 1.80 ≦ Vt0 < 2.10 | 0.32 |
| 1.50 ≦ Vt0 < 1.80 | 0.32 |
| Vt0 < 1.50 | 0.32 |

TABLE 3

| Linear Velocity Shift Compensation | |
|---|---|
| Vt0 [V] | ΔVt1 [V] |
| 3.60 ≦ Vt0 | 0.32 |
| 3.30 ≦ Vt0 < 3.60 | 0.32 |
| 3.00 ≦ Vt0 < 3.30 | 0.32 |
| 2.40 ≦ Vt0 < 3.00 | 0.32 |
| 2.10 ≦ Vt0 < 2.40 | 0.36 |
| 1.80 ≦ Vt0 < 2.10 | 0.41 |
| 1.50 ≦ Vt0 < 1.80 | 0.45 |
| Vt0 < 1.50 | 0.50 |

In step S130, the output value Vt is calculated by the following formula (1) using the output value Vt1 obtained in step S80 and the linear velocity shift compensation amount ΔVt1 obtained in step S110:

$$Vt=Vt1-\Delta Vt1 \quad (1).$$

Then, in step S70, the toner supply amount is calculated using corrected output value Vt of the toner concentration sensor and the toner concentration control reference value Vtref.

In step S90, if the previous linear velocity is not the standard linear velocity, the process proceeds to step S140. In step S140, the linear velocity shift compensation amount ΔVt1 which is saved in step S120 is read and the output value Vt is calculated using the formula (1) in step S150. More specifically, when printing operation is performed at low linear velocity mode successively, the compensation is performed using the linear velocity shift compensation amount ΔVt1 calculated when the linear velocity is changed.

This is the Vt compensation method according to the example embodiment. Thus, even in a case in which the linear velocity is changed, it is possible to compensate for the linear velocity shift amount by calculating a linear velocity shift amount from the output value Vt of the standard linear velocity saved just before the linear velocity is changed.

In step S110 in the flowchart of FIG. 4, the linear velocity shift amount is obtained by referring to the look-up-table. It is to be noted that, however, that the linear velocity shift amount may also be obtained from a relational equation between the output values of the toner concentration sensor for each of standard linear velocity and low linear velocity and the toner concentration without referring to the look up table. Such a control method will be now explained using flowchart shown in FIG. 5. A control operation represented in the flowchart shown in FIG. 5 is executed by the control unit 150 described previously.

Figure 5:
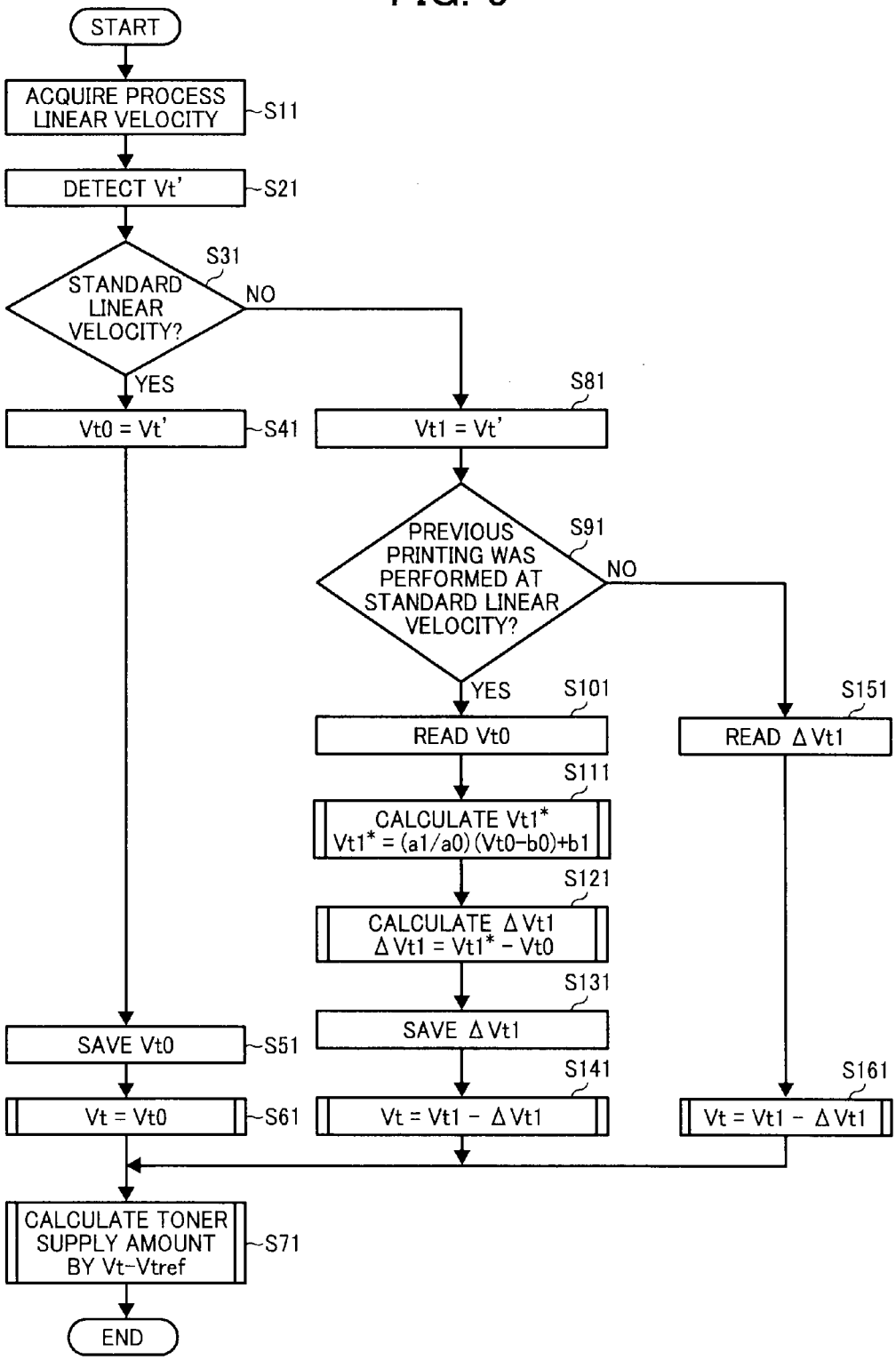
FIG. 5 is a flowchart of a control operation using calculation mode to derive a relational equation between the output value of the toner concentration sensor and the toner concentration.

Similarly to the flowchart shown in FIG. 4, when the process linear velocity is a standard linear velocity, the toner supply amount is calculated using the output value Vt0 as the output value Vt without conversion (steps S11 to S71 in FIG. 5).

Next, when the process linear velocity acquired in step S11 is a low linear velocity (60 mm/sec), the process proceeds to step S81 based on a determination made in step S31. In step S81, Vt1=Vt'.

In step S91, it is judged whether the previous linear velocity was the standard linear velocity. If the previous linear velocity was the standard linear velocity, the process proceeds to step S101. In step S101, the output value Vt0 that is the output value of the toner concentration sensor at the standard linear velocity and is stored in the memory is read.

After reading the output value Vt0, a linear velocity shift amount is calculated based on the output value Vt0.

In step S111, an output value Vt1* is calculated by the following formula (2) based on the output value Vt0:

$$Vt1^*=a1/a0\times(Vt0-b0)+b1 \quad (2).$$

The output value Vt1* is a calculated value for the output value of the toner concentration sensor at the low linear velocity with the same toner concentration for the output value Vt0.

Accordingly, a difference between the output value Vt1* and the output value Vt0 is the linear velocity shift amount at the toner concentration.

Now, the formula (2) will be explained. As shown in FIG. 3, a relation between the output value of the toner concentration sensor and the toner concentration for each case of standard linear velocity and low linear velocity can be expressed by a linear equation, and can be expressed as formulae (3) and (4), respectively:

$$\text{Standard: } y=a0\times x+b0 \quad (3), \text{ and}$$

$$\text{Low: } y=a1\times x+b1 \quad (4),$$

where "x" is the toner concentration and "y" is the output value of the toner concentration sensor, "a0" is the slope at standard linear velocity where horizontal axis is toner concentration [wt %] and vertical axis is output value of the toner concentration sensor [V], "a1" is the slope at low linear velocity, "b0" is the y intercept of the line for standard linear velocity, and "b1" is the y intercept of the line for low linear velocity.

The formula (2) can be obtained from formulae (3) and (4), where the output value Vt1* is the output value of the toner concentration sensor obtained at the low linear velocity under a condition in which the toner concentration is the same as the toner concentration for the output value Vt0 of the toner concentration sensor obtained at the standard linear velocity.

This is the derivation procedure to derive the formula (2) from formulae (3) and (4).

Formulae (3) and (4) are obtained using a calculation mode to derive a relational equation between the output value of the toner concentration sensor and the toner concentration described later. Alternatively, it is also effective to control operation using representative values obtained from experiments performed previously.

In step S121 in FIG. 5, linear velocity shift compensation amount ΔVt1 is calculated by the following formula (5) using the output value Vt1* obtained in step S111 and the output value Vt0:

$$\Delta Vt1=Vt1^*-Vt0 \quad (5).$$

Then, the linear velocity shift compensation amount ΔVt1 that is obtained by formula (5) is saved in step S131.

Further, in step 141, the output value Vt is calculated by inputting the linear velocity compensation amount obtained by formula (5) to formula (1). The toner supply amount is calculated using the output value Vt of the toner concentration sensor that is obtained in step S71 and the toner concentration control reference value Vtref.

Further, in step S91, if the previous linear velocity was not the standard linear velocity, the process proceeds to step S151. In step S151, the linear velocity shift compensation amount ΔVt1 saved in step S131 is read. In step S161, the output value Vt is calculated by the formula (1). More specifically, when the printing operation is performed successively at low linear velocity mode, the compensation is performed using the linear velocity shift compensation amount ΔVt1 calculated when the linear velocity is changed.

This is the compensation method by obtaining the linear velocity shift compensation amount using the relational equation between the output value of the toner concentration sensor for each case of standard linear velocity and low linear velocity and the toner concentration. Thus, it becomes possible to perform the compensation properly, that is, suitable for the toner concentration (the output value of the toner concentration sensor). Consequently, it becomes possible to determine the linear velocity shift compensation amount properly when the linear velocity is changed, resulting in more accurate toner supply control.

Figure 6:
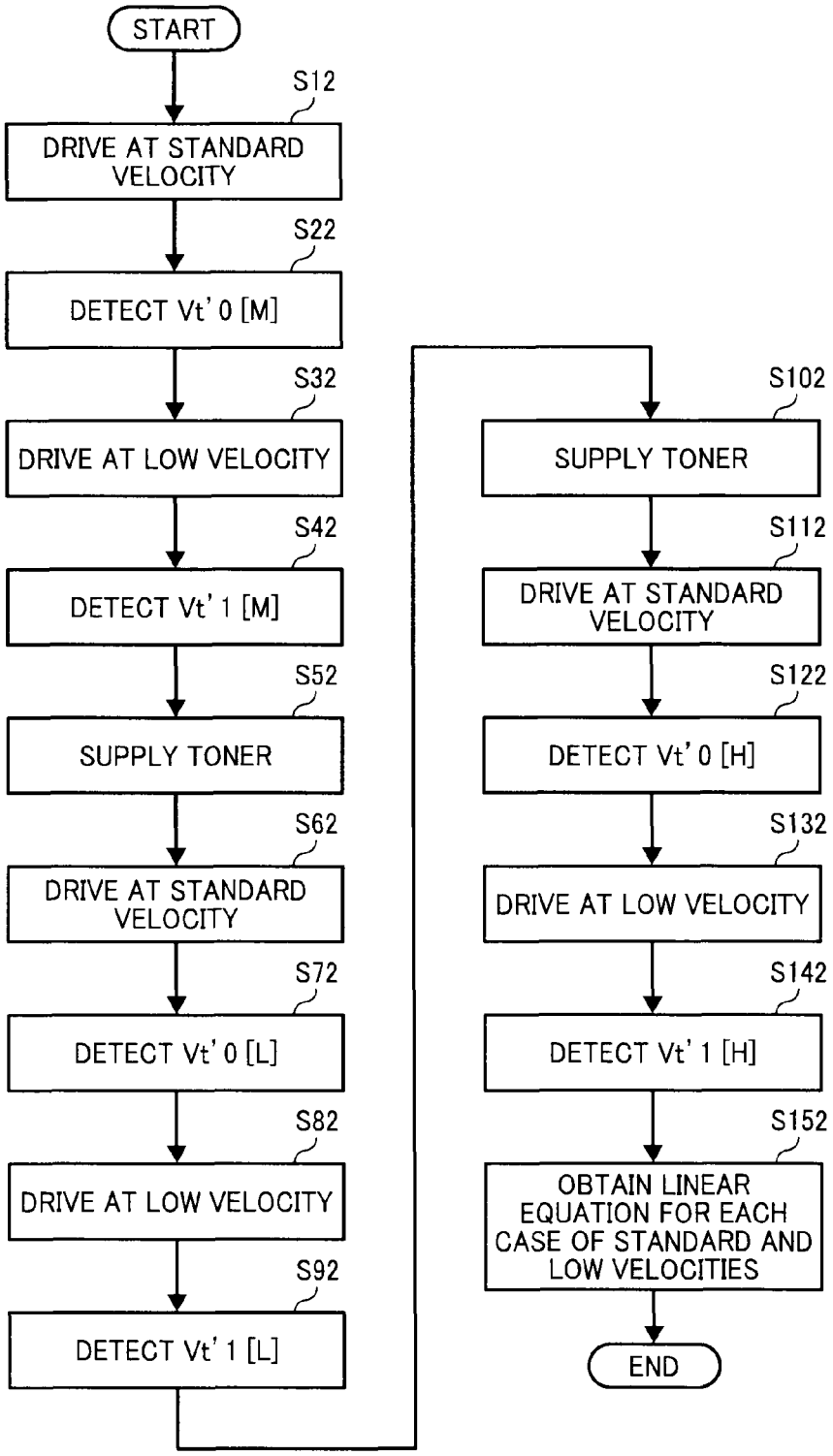
FIG. 6 is a flowchart showing steps in a control operation to obtain a relational equation between the output value of the toner concentration sensor and the toner concentration.

The calculation mode to calculate the relational equation between the output value from the toner concentration sensor and the toner concentration will be now described using FIG. 6. A control operation represented in the flowchart shown in FIG. 6 is also executed by the control unit 150 described previously.

In step S12 in FIG. 6, the printing operation is being performed at the standard linear velocity. In step S22, the output value V'0 [M] from the toner concentration sensor 5 is detected. In step S32, the linear velocity is changed from the standard linear velocity to a low linear velocity. In step S42, the output value V'1 [M] from the toner concentration sensor 5 is obtained. In this instance, the development device 4 is filled with developer having the reference toner concentration. In this example embodiment, the toner concentration is 7.0 wt %.

In step S52, toner is consumed so that the toner concentration in the development device 4 becomes 4.0 wt %. For example, when the volume of developer is 225 grams, the toner of 6.75 grams is consumed to reduce the toner concentration from 7.0 wt % to 4.0 wt %. A mat-type patch pattern may be formed to consume toner.

In step S62, the printing operation is performed at the standard linear velocity. In step S72, the output value V'0 [L] from the toner concentration sensor 5 is detected. In step S82, the printing operation is performed at the low linear velocity by switching from the standard linear velocity. In step S92, the output value V'1 [L] from the toner concentration sensor 5 is obtained.

In step S102, toner is supplied so that the toner concentration in the development device 4 becomes 11.0 wt %. For example, when volume of developer is 225 grams, the toner of 15.75 grams is supplied to increase the toner concentration from 4.0 wt % to 11.0 wt %.

When the capacity of the toner supply unit 17 to supply toner is 0.3 g/sec, it is necessary to supply toner for 52.5 seconds by driving the toner supply unit 17 in order to supply the proper amount of toner.

Similarly, in step S112 the printing operation is performed at the standard linear velocity. In step S122, the output value V'0 [H] from the toner concentration sensor 5 is detected. In step S132, the printing operation is performed at the low linear velocity by switching from the standard linear velocity. In step S142, the output value V'1 [H] from the toner concentration sensor 5 is obtained.

Figure 7:
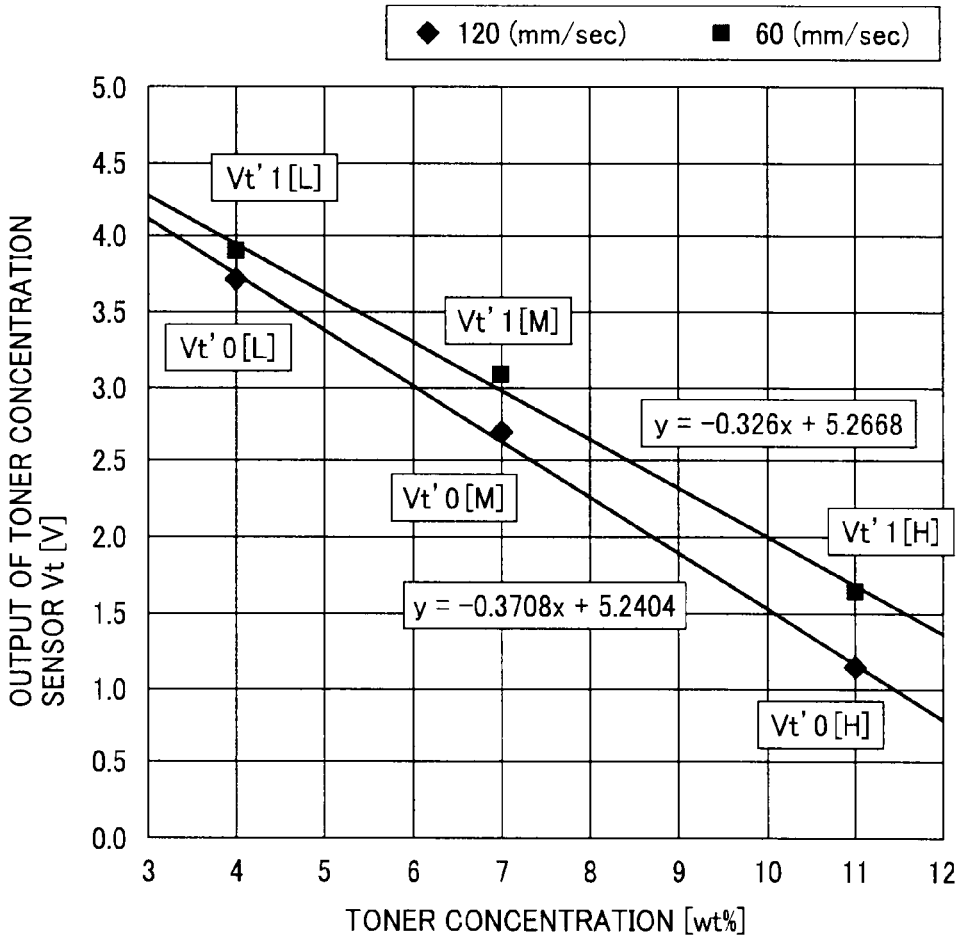
FIG. 7 is a graph representing a relation between output value of the toner concentration sensor at each process linear velocity and toner concentration and a linear equation obtained using a least square approximation method.

Further, referring to FIG. 7 in step S152, each linear equation will be derived for each of standard linear velocity and low linear velocity using a least square approximation method where the horizontal axis is the toner concentration and the vertical axis is the output value of the toner concentration sensor 5.

The linear equation obtained in step S152 for each case of standard linear velocity and low linear velocity is input to the formula (3) and the formula (4).

Thus, it is possible to derive the relational equation between the output value from the toner concentration sensor and the toner concentration.

This calculation mode is performed at power on when a new development unit is installed, and when the development unit or the developer is replaced. Further, this calculation mode may be performed when a linear velocity compensation amount obtained using the flowchart in FIG. 5 deviates from a desired value by a large amount. It is determined whether there is a large deviation by judging whether there is a large difference between the corrected output value Vt saved just before the linear velocity is changed from the low linear velocity to the standard linear velocity and the output value Vt detected after switching to the standard linear velocity.

The linear velocity compensation amount may deviate when the characteristic of the developer changes drastically to change the profile between the output value of the toner concentration sensor and the toner concentration.

Accordingly, it is possible to adjust the compensation amount for the change of the development characteristic by renewing the relational equation by performing the calculation mode that derives the relational equation between the output value of the toner concentration sensor and the toner concentration. For example, when the compensation error becomes larger than a predetermined value, a flag signal may be output to represent an order to renew the relational equation between the output value of the toner concentration sensor and the toner concentration. Accordingly, this calculation mode is performed at a predetermined timing, for example, power on, to renew the relational equation.

Thus, even when the characteristic of the developer changes drastically to change the profile between the output value from the toner concentration sensor and the toner concentration, it is possible to perform proper compensation of the linear velocity shift amount using this calculation mode.

More specifically, the flowchart in FIG. 5 will be explained using a concrete example.

For example, as a result of an execution of the steps illustrated in the flowchart in FIG. 6, linear equations are obtained as shown in FIG. 7:

$$\text{Standard: } y=-0.3708\times x+5.2404 \quad (6), \text{ and}$$

$$\text{Low: } y=-0.3260\times x+5.2668 \quad (7),$$

Slopes and the y intercepts of the line of the formulae (6) and (7) are input to the formula (2) in step S11 of the flowchart in FIG. 5:

$$Vt1^{*}=0.8791\times(Vt0-5.2404)+5.2668 \quad (8).$$

When the output value Vt0 is 2.40[V], the output value Vt1* is 2.77[V], the linear velocity shift compensation amount ΔVt1 is obtained as follows based on the formula (5) in step S121 of the flowchart in FIG. 5:

$$\Delta Vt1=2.77-2.40=0.37.$$

The output value Vt can be obtained by subtracting the linear velocity shift compensation amount ΔVt1 from the output value Vt1 of the toner concentration sensor.

Thus, the relational equation between the output value of the toner concentration sensor and the toner concentration is obtained to calculate the linear velocity compensation amount. Accordingly, it is possible to perform the compensation with grate accuracy, resulting in increase of accuracy of toner supply control.

According to the present invention, it is possible to realize the toner supply control operation with a grate accuracy. Consequently, it is possible to realize an image forming apparatus which forms image with a proper image density using this toner supply control method.

Numerous additional modifications and variations are possible in light of the above teachings. It is therefore to be understood that within the scope of the appended claims, the disclosure of this patent specification may be practiced otherwise than as specifically described herein.

What is claimed is:

1. An image forming apparatus comprising:

a developer unit configured to store two-component developer that includes toner and carrier and develop an electrostatic latent image formed on an image carrier;

a toner concentration detector configured to detect toner concentration in a developer unit;

a toner supply unit configured to supply toner to the developer unit; and a controller configured to control toner supply amount and function as a toner supply controller that has a memory and controls the toner supply unit by comparing an output value of the toner concentration detector with a reference value stored in the memory, and as a compensation unit that corrects a difference between output values of the toner concentration detector at two or more process linear velocities including a standard linear velocity, wherein a compensation amount for correcting the difference between output values of the toner concentration detector that differ depending on the process linear velocity is determined using a precomputed look-up table in accordance with the toner concentration in the development unit, wherein the look-up table includes a plurality of entries, each entry including a range of toner concentration values stored in association with a corresponding compensation amount.

2. The image forming apparatus of claim 1, wherein compensation amount for correcting difference between output values of the toner concentration detector is determined in accordance with the output value of the toner concentration detector at the standard linear velocity stored just before the process linear velocity is changed.

3. The image forming apparatus of claim 1, wherein the compensation amount is set to a value larger than a reference value when the output value of the toner concentration detector is at or below a predetermined value, and the compensation amount is set to a smaller value than the reference value when the output value of the toner concentration is higher than the predetermined value.

4. An image forming apparatus comprising:

a developer unit configured to store two-component developer that includes toner and carrier and develop an electrostatic latent image formed on an image carrier;

a toner concentration detector configured to detect toner concentration in a developer unit;

a toner supply unit configured to supply toner to the developer unit; and a controller configured to control toner supply amount and to function as a toner supply controller that has a memory and controls the toner supply unit by comparing an output value of the toner concentration detector with a reference value stored in the memory, and as a compensation unit that corrects a difference between output values of the toner concentration detector at two or more process linear velocities including a standard linear velocity and a low linear velocity in accordance with the toner concentration in the developer unit, wherein a compensation amount for correcting the difference between output values of the toner concentration detector is determined using a relational equation between the output values of the toner concentration detector for each of the standard linear velocity and the low linear velocity and the toner concentration; and the image forming apparatus enters a calculation mode when the difference between the output values of the toner concentration detector obtained before and after the linear velocity is changed from a low to standard exceeds a predetermined value.

5. The image forming apparatus of claim 4, wherein the image forming apparatus has a calculation mode to derive the relational equation.

6. The image forming apparatus of claim 4, wherein the compensation amount for correcting the difference between output values of the toner concentration detector is determined just after the process linear velocity is changed from the standard linear velocity to the low linear velocity.

7. The image forming apparatus of claim 4, wherein the calculation mode to derive the relational equation is entered at detection of installation of a new development unit.

8. A method for controlling image density in an image forming apparatus, comprising:

storing two-component developer that includes toner and carrier;

detecting toner concentration in a developer unit of the image forming apparatus with a toner concentration detector;

correcting a difference between output values of the toner concentration detector at two or more process linear velocities of the image forming apparatus including a standard linear velocity and a low linear velocity;

determining the toner supply amount by comparing the output value of the toner concentration detector with a reference value stored in a memory of the image forming apparatus; and supplying toner to the developer unit with a toner supply unit of the image forming apparatus, wherein a compensation amount for correcting the difference between output values of the toner concentration detector is determined using a relational equation between the output values of the toner concentration detector for each of the standard linear velocity and the low linear velocity and the toner concentration; and a calculation mode is performed when the difference between the output values of the toner concentration detector obtained before and after the linear velocity is changed from a low to standard exceeds a predetermined value.

9. The method for controlling image density in an image forming apparatus according to claim 8, wherein the compensation amount for correcting the difference between output values of the toner concentration detector is determined in accordance with the output value of the toner concentration detector at the standard linear velocity stored just before the process linear velocity is changed.

10. The method for controlling image density in an image forming apparatus according to claim 8, wherein the compensation amount is set to a value larger than a reference value when the output value of the toner concentration detector is at or below a predetermined value, and the compensation amount is set to a value smaller than the reference value when the output value of the toner concentration is higher than the predetermined value.

11. The method for controlling image density in an image forming apparatus according to claim 8, wherein the image forming apparatus has a calculation mode to derive the relational equation.

12. The method for controlling image density in an image forming apparatus according to claim 8, wherein the compensation amount for correcting the difference between output values of the toner concentration detector is determined just after the process linear velocity is changed from the standard linear velocity to the low linear velocity.

13. The method for controlling image density in an image forming apparatus according to claim 8, wherein the calculation mode to derive the relational equation is entered at detection of installation of a new development unit.

* * * * *